US005220241A

United States Patent [19]

Kanazawa et al.

[11] Patent Number: 5,220,241

[45] Date of Patent: Jun. 15, 1993

[54] DEFLECTION YOKE HAVING HORIZONTAL AUXILIARY COILS FOR REDUCING UNNECESSARY RADIANT MAGNETIC FIELD

[75] Inventors: Shuichi Kanazawa, Koushoku; Hideyuki Inoue, Ueda, both of Japan

[73] Assignee: Totoku Electric Co., Ltd., Tokyo, Japan

[21] Appl. No.: 689,225

[22] Filed: Apr. 22, 1991

[30] Foreign Application Priority Data

Apr. 28, 1990 [JP] Japan ..... 2-45758[U]

[51] Int. Cl.[5] ..... H01J 29/70

[52] U.S. Cl. ..... 313/440; 313/431; 313/413; 335/210; 335/214

[58] Field of Search ..... 313/440, 431, 413, 433; 335/210, 213, 214

[56] References Cited

U.S. PATENT DOCUMENTS

| | | | |
|---|---|---|---|
| 4,992,697 | 2/1991 | Penninga et al. | 313/440 |
| 5,049,847 | 9/1991 | Okuyama et al. | 313/440 |
| 5,124,613 | 6/1992 | Park et al. | 313/440 |

*Primary Examiner*—Donald J. Yusko

*Assistant Examiner*—N. D. Patel

*Attorney, Agent, or Firm*—Jordan and Hamburg

[57] ABSTRACT

A deflection yoke includes a horizontal deflection coil including a pair of saddle-shaped coils having a front transverse conductor and a rear conductor; a pair of void-core type horizontal auxiliary coils disposed only on the front transverse conductor, each auxiliary coil having a front semi-circular arc side part, a rear semi-circular arc side part, a right straight side part connected between the front semi-circular arc side part and a left straight side part connected between the front semi-circular arc side part, the horizontal auxiliary coils being connected with the horizontal deflection coil, such that a horizontal deflection current flows in the horizontal auxiliary coils in a direction corresponding to a more intense leak magnetic field generated by the front transverse conductor of the horizontal deflection coil; and a coil holder for holding the horizontal auxiliary coils such that the front semi-circular arc side parts are positioned along the front transverse conductor of the pair of saddle-shaped coils, respectively, and the rear semi-circular arc side parts are positioned adjacent a middle part of a core which is positioned behind the horizontal deflection coil.

5 Claims, 5 Drawing Sheets

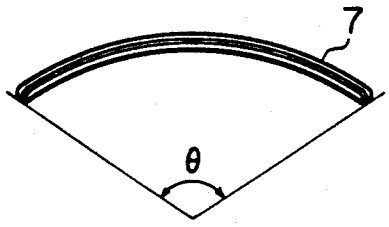
Fig. 3
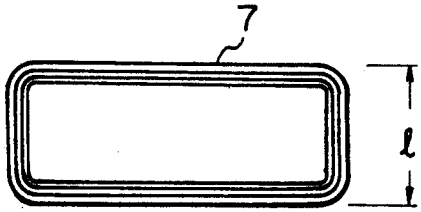
Fig. 4
Fig. 5
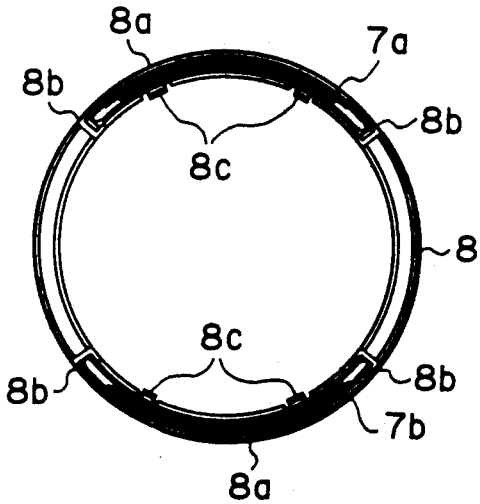
Fig. 6
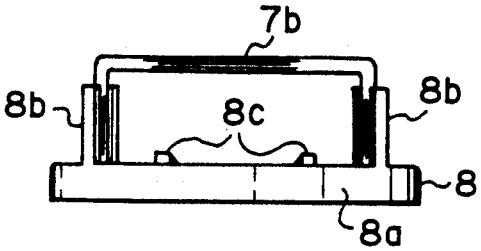

Fig. 7
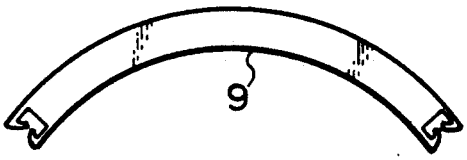
Fig. 8
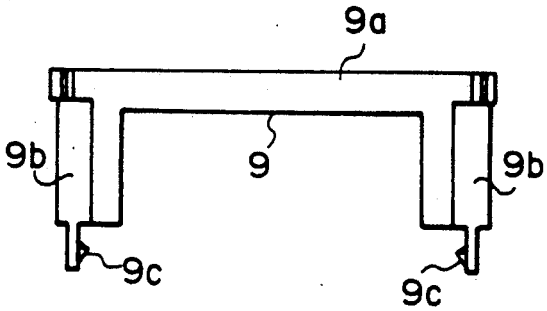
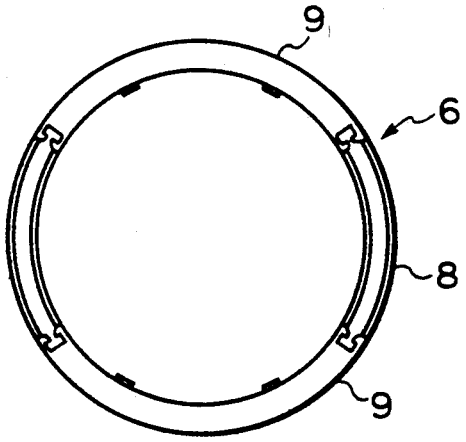
Fig. 9
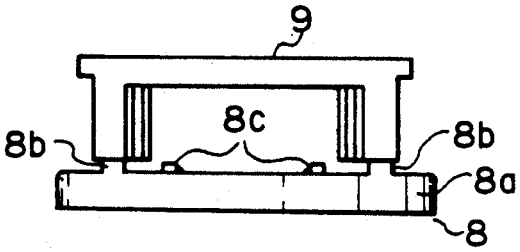
Fig. 10

DEFLECTION YOKE HAVING HORIZONTAL AUXILIARY COILS FOR REDUCING UNNECESSARY RADIANT MAGNETIC FIELD

BACKGROUND OF THE INVENTION

1. Field of the Invention

This invention relates to a deflection yoke incorporated in such a device as a television receiver or a CRT display unit, and particularly to a deflection yoke which can reduce an unnecessary radiant magnetic field.

2.Description of the Prior Art

In recent years, unnecessary radiant magnetic fields from CRT display units of, for instance, computer terminals, especially an unnecessary radiant magnetic field from a high frequency horizontal deflection coil sometimes affects other terminal units nearby and causes a malfunction thereof, which is a problem to be solved. For this reason, it is strongly desired to reduce an unnecessary radiant magnetic field from the CRT display units.

As a source of the aforesaid unnecessary radiant magnetic field, such devices as a deflection yoke, a flyback transformer, a size coil, a linear coil can be listed, but the main source is a deflection yoke.

Of magnetic fields leaked from the deflection yoke, those other than that in an axial direction of a CRT tube can be shielded, but it is impossible to shield a magnetic field leaked from a CRT face (because the face can not be covered), and so far any effective countermeasure has not been applied to this problem. Recently, it has been tried to offset a leak magnetic field and reduce an unnecessary radiant by adding to a deflection yoke 1 a pair of saddle-shaped horizontal auxiliary coils 13*a* and 13*b* (FIG. 14), or a pair of horizontal coil made by winding wire around bobbins respectively 14*a* and 14*b* (FIG. 15) to generate a magnetic field which is reverse to the leak magnetic field from the horizontal deflection yoke.

In the conventional technology, however, a saddle-shaped coil or a bobbin-shaped coil is used as a horizontal auxiliary coil, but the coils' form and construction are complicated or a bobbin is required, which causes troubles in manufacturing.

Moreover, to mount a horizontal auxiliary coil to a deflection yoke, a complicated construction of a coil separator is required, and in addition to it the horizontal auxiliary coil largely extends to the outside from a periphery of a front edge opening of the deflection yoke, which also causes a space-related problem.

SUMMARY OF THE INVENTION

A purpose of this invention is to provide a deflection yoke which reduces an unnecessary radiant magnetic field generated therein and allows easy production of horizontal auxiliary coils therefor, and at the same time which does not require a large space and to which the horizontal auxiliary coil can easily be mounted.

In the first aspect, this invention provides a deflection yoke, wherein a horizontal deflection coil includes a pair of saddle-shaped coils, characterized in a pair of void-core type of horizontal auxiliary coils having a form of saddle are received by a coil holder and the coil holder receiving said horizontal auxiliary coils is set at a position where said horizontal auxiliary coils stride over a forward bend section of each of said pair of horizontal deflection coil in a manner allowing the coil holder to be mounted on or off, and also that said horizontal auxiliary coils are connected to said horizontal deflection coil and a horizontal deflection current flows in said horizontal auxiliary coils in a direction for a more intense leak magnetic field generated by said forward bend section of said horizontal deflection coil.

In the above-described configuration, the coil holder, which receives said pair of horizontal auxiliary coils, preferably is formed as an integrated unit having a form of circular ring so that said coil holder can be mounted onto and off from a periphery of a forward opening section of the aforesaid horizontal deflection coil.

Also preferably, the aforesaid horizontal auxiliary coils are made by winding a litz wire.

Also preferably, the aforesaid horizontal auxiliary coils are made by winding a wire made by twisting or simply bundling several small-diameter insulating wires.

In the deflection yoke according to this invention, a pair of void-core horizontal auxiliary coils having a form of saddle are connected to a horizontal deflection coil, and at the same time is set at a position where said horizontal auxiliary coils stride over each forward bend section of said horizontal deflection coil with a coil holder in a way allowing the coil holder to be loaded on or off. Because of this configuration, when a horizontal deflection current flows in the aforesaid horizontal auxiliary coils in a direction for more intense magnetic fields leaked from each forward bend section of said horizontal deflection coils, a composite magnetic field generated by each of the forward bend sections and the horizontal auxiliary coil works to offset a magnetic field leaked from said horizontal deflection coil in a forward direction of the CRT screen, so that an unnecessary radiant magnetic field is reduced.

BRIEF DESCRIPTIONS OF THE DRAWINGS

FIG. 3 and FIG. 4 are illustrations of a void-core horizontal auxiliary coil.

FIG. 5 and FIG. 6 show a rear view and a side view of a coil holder having a form of circular ring with the void-core horizontal auxiliary coil set thereon respectively.

FIG. 7 and FIG. 8 show a rear view and a side view of the insulating cover.

FIG. 9 and FIG. 10 show a rear view and a side view of the horizontal auxiliary coil unit respectively.

DESCRIPTION OF THE PREFERRED EMBODIMENTS

Description is made hereunder for an embodiment of this invention with reference to drawings thereof.

Figure 1:
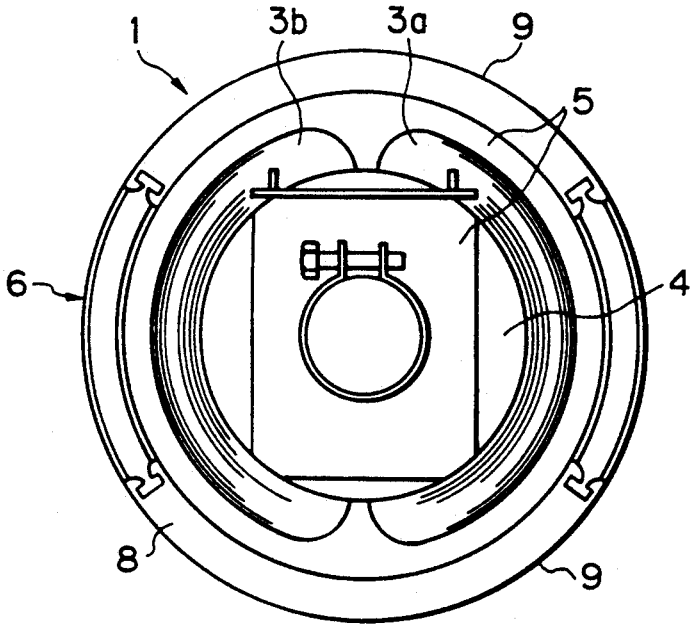
FIG. 1 and FIG. 2 show a rear view and a side view of an embodiment of the deflection yoke according to this invention respectively.
Figure 2:
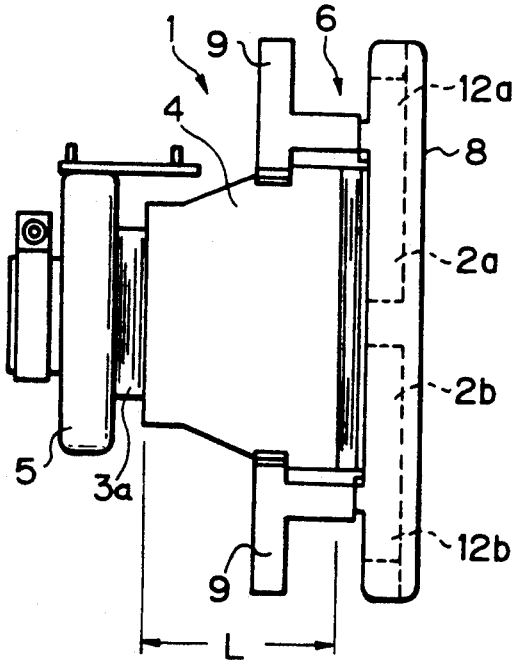

FIG. 1 and FIG. 2 show a rear view and a side view of a deflection yoke with a horizontal auxiliary coil mounted thereon respectively.

In the figures, 1 is the deflection yoke, 2a and 2b are front saddle-shaped horizontal deflection coils having front transverse conductors 12a and 12b, 3a and 3b are rear saddle-shaped vertical deflection coils having rear conductors, 4 is a core, 5 is a coil separator, 6 is a horizontal auxiliary coil unit wherein the horizontal auxiliary coil is received by the coil holder 8 having a form of circular ring.

FIG. 3 and FIG. 4 are illustrations for a saddle-shaped void-core coil 7 composing said horizontal auxiliary coil. Said void-core coil 7 is formed in a similar form to that of the forward bend section of said horizontal deflection coil with a width of $\theta$ (FIG. 3) and a length of l (FIG. 4), using a self welding wire having a welding layer made of such a material as polyamide around an insulation layer made of such a material as polyurethane or polyester.

FIG. 5 and FIG. 6 show a rear view and a side view of the coil holder 8 having a form of circular ring which receives the pair of void-core coils 7a and 7b respectively to illustrate a construction thereof. The aforesaid coil holder 8 comprises a bag section 8a to receive the void-core coils 7a and 7b therein and a support 8b which supports said void-core coils 7a and 7b. A claw 8c is provided having elasticity for setting the coil holder 8 in the coil separator 5 on a periphery of a forward opening section of each of the horizontal deflection coils 2a and 2b in a way allowing said coil holder 8 to be mated with said coil separator 5 easily.

The pair of void-core coils 7a and 7b are received and supported by the coil holder 8 at a position where the coils 7a and 7b face each other, and are set to the support 8b of the coil holder 8 in a way allowing the coils 7a and 7b to be engaged with or released from the support 8b easily.

FIG. 7 and FIG. 8 show a rear view and a side view of the insulating cover 9 respectively.

The void-core coils 7a, 7b and the support 8b are covered with the cylindrical insulating cover 9 having elastic tongue pieces 9a and 9b, as shown in FIG. 9 and FIG. 10, to form the horizontal auxiliary coil unit 6.

The horizontal auxiliary coil unit 6 thus formed is engaged with the coil separator 5 along a periphery of the forward opening of the horizontal deflection coils 2a and 2b with the claw 8c. Then, the pair of void-core coils 7a and 7b are mounted at a position where said pair of void-core coils 7a and 7b stride over the bend sections 12a and 12b at a top and a bottom of the vertical shaft of the horizontal deflection coils 2a and 2b.

Figure 13:
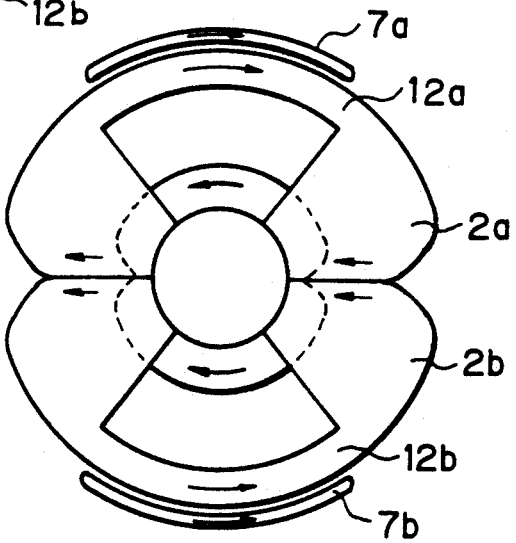
FIG. 13 is an illustration of a current flowing in the horizontal deflection coil and the horizontal auxiliary coil.
Figure 14:
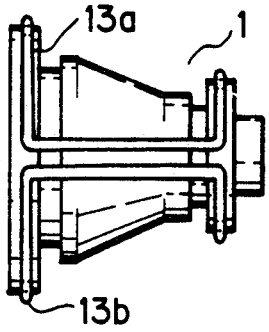
Fig. 14 PRIOR ART
FIG. 14 shows a side view of an example of conventional deflection yoke.
Figure 15:
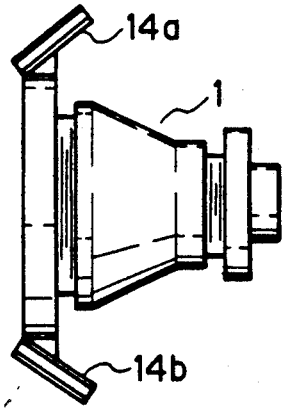
Fig. 15 PRIOR ART
FIG. 15 shows a side view of other example of conventional deflection yoke.

And, the pair of void-core coils 7a and 7b are connected in parallel or in series to the horizontal deflection coils 2a and 2b, and it becomes possible for a horizontal deflection current to flow in the direction for more intense magnetic field leaked forward by bend sections or front transverse conductors 12a and 12b of the horizontal deflection coils 2a and 2b as shown in FIG. 13.

Figure 11:
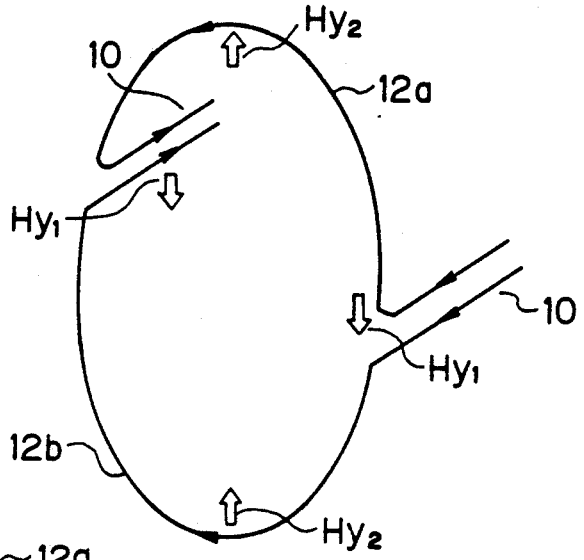
FIG. 11 is an illustration of a current flowing in the horizontal deflection coil and the horizontal auxiliary coil.
Figure 12:
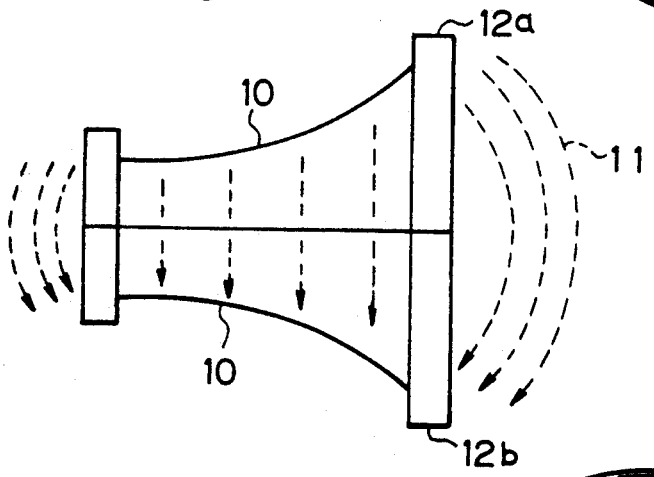
FIG. 12 is an illustration of a magnetic field around the horizontal deflection coil.

With the deflection yoke 1 having the above-described configuration, a magnetic field around the forward opening of the pair of saddle-shaped horizontal deflection coils 2a and 2b is a composite magnetic field, as shown in FIG. 11, composed of a magnetic field Hy1 generated by the main deflecting coil 10 and a magnetic field Hy2 generated by the forward bend sections 12a and 12b, but as the magnetic field Hy2 generated by the forward bend sections 12a and 12b is reverse to the magnetic field Hy1 generated by the main deflection coil 10 in terms of a magnetic field direction, the forward bend sections 12a and 12b work to reduce a magnetic field 11 leaked to the direction of a tube face of the forward opening of the horizontal deflection coil shown in FIG. 12.

For this reason, saddle-shaped void-core coils 7a and 7b are arranged along a periphery of the forward bend sections 12a and 12b so that said saddle-shaped void-core coils 7a and 7b stride over said forward bend sections 12a and 12b to enhance work of said forward bend sections 12a and 12b, and because of this feature, the magnetic field 11 leaked to the direction of a tube face in the side of the opening of the horizontal deflection coils 2a and 2b can be reduced.

Results of a testing show that, in case of a 14-inch saddle-saddle type of deflection yoke, a magnetic field can be reduced to 20 mT/S or below at a tube face for the void-core coils 7a and 7b having a width $\theta$ from 80 degrees to 120 degrees and a length l from 20 to 40 mm.

Note that a purpose of the deflection yoke according to this invention is to make a magnetic field generated around a forward bend section of a horizontal deflection coil more intense than that generated by a horizontal deflection coil. For this reason, a length l of a coil may be shorter than that based on the conventional technology, and an adequate effect can be achieved with a length l which is around a half of the core length L.

In the description of an embodiment above, a saddle-saddle type of deflection yoke was described as an example, but it is needless to say that the same effect can be achieved also in a saddle-toroidal type of deflection yoke.

Also, the coil holder 8 may not be an integrated one, and may be a divided one.

Also it is needless to say that the void-core coils 7a and 7b may be made by winding wires made by bundling and twisting litz wires or small-diameter insulating wires or simply winding bundled wires.

In this invention, as a complicated bobbin is not used and void-core coils are used, a production cost of the coils is low. In addition to it, the horizontal auxiliary coil comprising saddle-shaped void-core coils can easily be mounted on and off. Moreover, the form of the horizontal auxiliary coil is almost the same as that of the forward bend section of the horizontal coil, which enables space saving. Additionally, as the pair of auxiliary coils is arranged at a position for enhancing a magnetic field around the forward bend section, an unnecessary radiant magnetic field to the direction of the tube face can be reduced efficiently, and the industrial effect thereof is substantially large.

We claim:

1. A deflection yoke comprising:

a horizontal deflection coil including a pair of saddle-shaped coils having a front transverse conductor and a rear conductor, a pair of void-core type horizontal auxiliary coils disposed only on said front transverse conductor, each horizontal auxiliary coil having a front semi-circular arc side part, a rear semi-circular arc side part, a right straight side part connected between the front semi-circular arc side part and a left straight side part connected between the front semi-circular arc side part, said horizontal auxiliary coils being connected with said horizontal deflection coil, such that a horizontal deflection current flows in said horizontal auxiliary coils in a direction corresponding to a more intense leak magnetic field generated by said front transverse conductor of said horizontal deflection coil, and coil holder means for holding said horizontal auxiliary coils such that said front semi-circular arc side parts are positioned along the front transverse conductor of said pair of saddle-shaped coils, respectively, and said rear semi-circular arc side parts are positioned adjacent a middle part of a core which is positioned behind said horizontal deflection coil.

2. The deflection yoke according to claim 1, wherein each said coil holder means is formed in a circular arc and is releasably engaged with a periphery of said front transverse conductors of said horizontal deflection coil.

3. The deflection yoke according to claim 1, wherein each said horizontal auxiliary coil is made by wound litz wires.

4. The deflection yoke according to claim 1, wherein said horizontal auxiliary coils are made of wound wires, said wires being formed of twisted small-diameter insulating wires.

5. The deflection yoke according to claim 1, wherein said horizontal auxiliary coils are made of wound wires, said wires being formed of bundled small-diameter insulating wires.

* * * * *